US009951450B2

(12) United States Patent
Joung et al.

(10) Patent No.: US 9,951,450 B2
(45) Date of Patent: Apr. 24, 2018

(54) SYSTEM FOR INJECTING FUNCTIONAL SOLUTION FOR FABRIC AND METHOD FOR MANUFACTURING FABRIC USING SAME

(71) Applicant: JIOS AEROGEL CORPORATION, Osan (KR)

(72) Inventors: Young chul Joung, Hwaseong (KR); Myung je Roh, Seoul (KR); Jong chul Park, Osan (KR); Min woo Kim, Daejeon (KR); Mun hyeong Lee, Osan (KR); In chang Cha, Osan (KR)

(73) Assignee: Armacell JIOS Aerogels Limited, Wanchai (HK)

( * ) Notice: Subject to any disclaimer, the term of this patent is extended or adjusted under 35 U.S.C. 154(b) by 165 days.

(21) Appl. No.: 14/997,420

(22) Filed: Jan. 15, 2016

(65) Prior Publication Data

US 2016/0130736 A1 May 12, 2016

Related U.S. Application Data

(63) Continuation of application No. PCT/KR2013/006538, filed on Jul. 22, 2013.

(30) Foreign Application Priority Data

Jul. 15, 2013 (KR) ..... 10-2013-0082654

(51) Int. Cl.
*D06B 19/00* (2006.01)
*D06M 11/45* (2006.01)
(Continued)

(52) U.S. Cl.
CPC ..... *D06B 19/0017* (2013.01); *B05C 5/02* (2013.01); *D06B 1/02* (2013.01); *D06B 5/08* (2013.01);
(Continued)

(58) Field of Classification Search
None
See application file for complete search history.

(56) References Cited

U.S. PATENT DOCUMENTS 1,456,344 A * 5/1923 Van Ness ..... D06B 11/00 118/35
3,452,671 A * 7/1969 Lange ..... D06H 1/003 101/26
(Continued)

FOREIGN PATENT DOCUMENTS

EP 1065004 A1 1/2001
EP 1787716 A1 5/2007
(Continued)

OTHER PUBLICATIONS

JIOS Aerogel Limited, Communication Pursuant to Rules 161(2) and 162, EP13886647.0, Feb. 12, 2016, 2 pgs.
(Continued)

*Primary Examiner* — Jethro M Pence
(74) *Attorney, Agent, or Firm* — Morgan, Lewis & Bockius LLP

(57) ABSTRACT

The present invention relates to a system for injecting a functional solution for fabric and a method for manufacturing fabric using same. The system includes: a first supply portion; a second supply portion provided with a distributing device; an injection portion provided with a needle; a drying portion provided with a hot air blower or a blower; and a collection portion provided with a collecting roll. An injection method is provided in which the needle on the injection portion, installed so as to be moved reciprocally, is directly inserted into the fabric to inject the functional solution, so that the functional solution is absorbed from the outer surface to the inside of the fabric.

19 Claims, 7 Drawing Sheets

(51) Int. Cl.

| | |
|---|---|
| ***D06M 11/46*** | (2006.01) |
| ***D06M 11/49*** | (2006.01) |
| ***D06M 11/77*** | (2006.01) |
| ***F26B 13/10*** | (2006.01) |
| ***B05C 5/02*** | (2006.01) |
| ***D06B 1/02*** | (2006.01) |
| ***D06B 9/00*** | (2006.01) |
| ***D06M 11/74*** | (2006.01) |
| ***D06M 23/08*** | (2006.01) |
| ***D06M 23/10*** | (2006.01) |
| ***D06B 5/08*** | (2006.01) |

(52) U.S. Cl.

CPC ..... *D06B 9/00* (2013.01); *D06M 11/45* (2013.01); *D06M 11/46* (2013.01); *D06M 11/49* (2013.01); *D06M 11/74* (2013.01); *D06M 11/77* (2013.01); *D06M 23/08* (2013.01); *D06M 23/10* (2013.01); *F26B 13/10* (2013.01)

(56) References Cited

U.S. PATENT DOCUMENTS

| | | | | |
|---|---|---|---|---|
| 4,932,942 | A * | 6/1990 | Maslanka | A61B 1/12 604/164.09 |
| 5,948,314 | A | 9/1999 | Gerhard et al. | |
| 2005/0100728 | A1 | 5/2005 | Ristic-Lehmann et al. | |
| 2009/0148654 | A1 | 6/2009 | Brown et al. | |
| 2009/0183826 | A1 | 7/2009 | Calvert | |

FOREIGN PATENT DOCUMENTS

| | | | | |
|---|---|---|---|---|
| GB | 2187419 | A | 9/1987 | |
| JP | 11-128824 | A | 5/1999 | |
| KR | 1019870000453 | B1 | 3/1987 | |
| KR | 940005759 | B1 | 6/1994 | |
| KR | 10-0783012 | B1 | 12/2007 | |
| KR | 10-2012-0133856 | * | 12/2012 | D06B 15/02 |
| KR | 20120133856 | A | 12/2012 | |
| WO | WO96/02695 | A1 | 2/1996 | |
| WO | WO96/03353 | A1 | 8/1996 | |
| WO | WO03/064025 | A1 | 8/2003 | |
| WO | WO03/097227 | A1 | 11/2003 | |
| WO | WO2006/002440 | A2 | 1/2006 | |
| WO | WO2006/100277 | A1 | 9/2006 | |
| WO | WO2012/044052 | A2 | 4/2012 | |

OTHER PUBLICATIONS

JIOS Aerogel Limited, Extended European Search Report, EP13886647.0, dated Mar. 28, 2017, 5 pgs.
JIOS Aerogel Limited, Communication Pursuant to Rules 70(2) and 70a(2), EP13886647.0, Apr. 18, 2017 1 pg.
JIOS Aerogel Limited, Communication Pursuant to Rules 161(2) and 162, EP13889597.4, Mar. 17, 2016, 2 pgs.
JIOS Aerogel Limited, Communication Pursuant to Rules 70a(2) and 70(2), EP13889597.4, Apr. 18, 2017, 1 pg.
Armacell JIOS Aerogels Limited, Extended European Search Report, EP13889597.4, dated Mar. 29, 2017, 8 pgs.
JIOS Aerogel Corporation, Communication Pursuant to Rules 161(2) and 162, EP13890228.3, Mar. 2, 2016, 2 pgs.
Armacell JIOS Aerogel Corporation, Communication Pursuant to Rules 70(2) and 70a(2), EP13890228.3, May 31, 2017, 1 pg.
Armacell JIOS Aerogesl Limited, Partial Supplementary European Search Report, EP13890228.3, dated Feb. 8, 2017, 8 pgs.
JIOS Aerogel Corporation, Communication Pursuant to Rules 161(2) and 162, EP14898765.4, Mar. 9, 2017, 2 pgs.
JIOS International Search Report and Written Opinion, PCT/KR2013/006538, dated Apr. 30, 2014, 7 pgs.
JIOS International Preliminary Report on Patentability, PCT/KR2013/006538, dated Jan. 19, 2016, 5 pgs.
Joung, Office Action, U.S. Appl. No. 14/896,936, dated Aug. 12, 2016, 11 pgs.
Joung, Final Office Action, U.S. Appl. No. 14/896,936, dated Apr. 20, 2017, 10 pgs.
Machine translation of JPH11-128824A, Hone, generated Nov. 21, 2016, 9 pgs.
Armacell JIOS Aerogels Limited, Communication Pursuant to Rule 114(2), EP13889597.4, May 8, 2017, 6 pgs.

* cited by examiner

SYSTEM FOR INJECTING FUNCTIONAL SOLUTION FOR FABRIC AND METHOD FOR MANUFACTURING FABRIC USING SAME

RELATED APPLICATIONS

This application is a continuation application of the international patent application number PCT/KR2013/006538, filed Jul. 22, 2013, which claims the priority to the Korean patent application number 10-2013-0082654, filed Jul. 15, 2013, both of which are incorporated by reference herein in their entireties.

TECHNICAL FIELD

The present invention relates to an injection system for injecting a functional solution into fabric for insulation, waterproofing, antifouling, antibacterial, flame retardant, and other properties. More specifically, the present invention relates to a fabric injection system for injecting a functional solution into fabric with a needle, and a method for manufacturing fabric using the same.

BACKGROUND

Generally, clothing has been means for protecting human bodies from external environments and, in modern days, has become means of fashion for expressing oneself to others. Recently, functional clothing having insulation, waterproofing, antifouling, antibacterial, flame retardant, and other advantageous properties, in addition to being means of fashion, is drawing attention. To manufacture such clothing, special processing is performed on fabrics.

As an example, fabric having insulation functionality is permeated with aerogel, which is used as an insulation material due to its very low thermal conductivity. The aerogel, made of silicon oxide ($SiO_2$), has been recognized as a novel material, which has drawn attention, since its discovery in the 1930s, as an insulation material, an impact absorbing material, and a soundproofing material, etc. as it is resistant to heat, electricity, sound, and impact, etc., and is only three times as heavy as air of the same volume. Further, aerogel is formed of silicon oxide threads having a diameter of one ten-thousandth of human hair, tangled extremely sparsely, and air molecules occupy the space between threads, and air accounts for 98% of the total volume.

A system and method of processing fabric using aerogel as a wetting agent is disclosed in Korean Patent No. 01255631, which was granted from a patent application filed by the present applicant. In short, the patented system includes a mixture supply part, a non-woven fabric supply roll, an insulation processing and transporting part permeating a mixture into a non-woven fabric using a blade, a drying part, and an insulation padding collecting roll.

SUMMARY OF THE INVENTION

However, when using a blade, a mixture is permeated slowly, the permeation takes a long time, and thus a lengthy permeation process is required. Accordingly, the processing time of the overall process is long, which is disadvantageous.

In particular, such permeation method or other coating methods cause absorption of a wetting agent from the outer surface of the fabric to the inside, and since the wetting agent cannot penetrate deeply inside the fabric, the wetting agent can be easily separated from the fabric by light friction on the outside or heavy friction such as washing.

It is an object of the present invention to solve the above problem to provide an injection system for injecting a functional solution with insulation, waterproofing, antifouling, antibacterial, flame retardant, and other properties directly into fabric with a needle, and a method for manufacturing fabric using the same.

As mentioned above, the present invention provides a novel and revolutionary injection method, which is completely different from the conventional method of causing absorption of a functional solution from the outer surface of the fabric to the inside, of injecting the functional solution directly into the fabric by inserting the needle of an injection portion configured to move reciprocally.

Also, by directly injecting the functional solution into the fabric, there are effects that it is possible to prevent the functional solution from being separated from the fabric by friction with the outside in a condition where the functional solution is concentrated in the outer surface of the fabric by the conventional penetration or coating method, and that the functional solution remains in the fabric for a long period of time, and thus its function may be maintained to the most.

Also, the functional solution may be absorbed in the outer surface of the fabric by the conventional penetration or coating method after injecting the functional solution into the fabric, and thus there are effects that the function of the functional solution may be exerted to the most, and the maintenance period of the function may be maximized.

In addition, there are effects that a predetermined amount of the functional solution may be introduced into the fabric, and that the process time may be reduced as the movement velocity of the fabric is faster than the conventional penetration or coating method by injecting the functional solution quickly and continuously.

BRIEF DESCRIPTION OF DRAWINGS

The accompanying drawings attached to the specification illustrate embodiments of the present invention, which, when viewed in conjunction with the detailed description of the invention, assist better understanding of the technical aspects of the present invention. However, the drawings should not be construed to limit the scope of the present invention.

EXPLANATION ON REFERENCE NUMERAL

Figure 1:
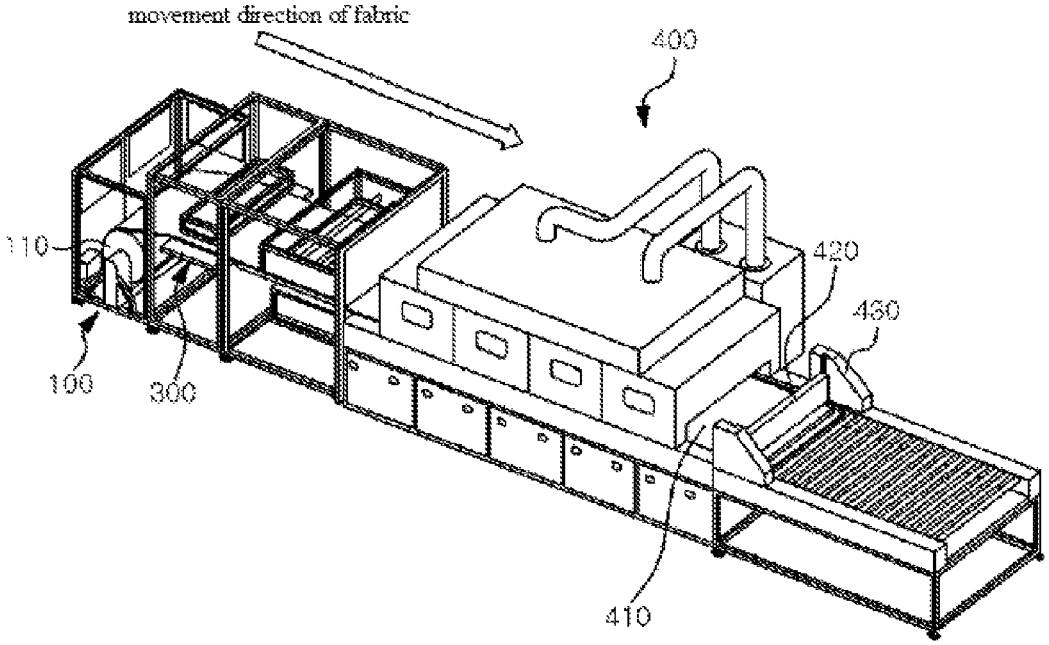
FIG. 1 is a perspective view schematically illustrating a system for injecting a functional solution for fabric according to an embodiment of the present invention.

100: first supply portion
110: supply roll

200: second supply portion
210: tank
220: stirring motor
230: stirring wing
240: level gauge
250: tank frame
260: distributing device
261: supply line
262: distributor
300: injection portion
310: first robot
320: supporting member
330: second robot
340: needle valve
350: needle block
360: needle socket
370: needle
400: drying portion
410: conveyor
420: height adjustment plate
430: fixing member

DETAILED DESCRIPTION

In order to achieve the above object, the system for injecting a functional solution for fabric according to the present invention includes a first supply portion provided with a supply roll for winding fabric; a second supply portion provided with a tank for manufacturing a functional solution by mixing functional materials having insulation, waterproofing, antifouling, antibacterial, and/or flame retardant properties with solvents, and a distributing device for discharging the functional solution stored in the tank; an injection portion provided with a needle for injecting the functional solution supplied from the distributing device to inside the fabric transferred from the first supply portion; a drying portion provided with a hot air blower or a blower for discharging hot air of a temperature higher than the boiling point of the solvent in order to evaporate the solvent from the fabric passing through the injection portion; and a collection portion provided with a collecting roll for winding the fabric passing through the drying portion.

Here, the functional solution is made by mixing an aerogel powder with a solvent.

Also, the aerogel powder is characterized for having a particle size of 20±5 μm.

Also, the aerogel powder is characterized for having been mixed at a weight ratio between 5 and 15.

Also, the solvent is one of an organic solvent, such as normal hexane, heptane, toluene, and xylene; an alcohol including methyl alcohol and/or ethyl alcohol; or a non-polar solvent.

Also, the functional solution includes one or two or more of titanium dioxide ($TiO_2$), aluminum oxide ($Al_2O_3$), silicon carbide (SiC) and iron hydroxide ($Fe_2O_3$) micro powder added thereto at a weight ratio between 2 and 5.

Also, the viscosity of the functional solution is between 700 and 1,500 centipoise (cp).

Also, the fabric is one of inorganic glass fiber mat, polyethylene (PE) non-woven fabric, polyethylene terephthalate (PET) non-woven fabric or organic fiber mat.

Here, the thickness of the fabric is between 5 and 20 mm.

Also, the density of the inorganic glass fiber mat is between 0.09 and 0.11 g/cm$^3$, and the density of the organic fiber mat is between 0.025 and 0.03 g/cm$^3$.

Also, the movement velocity of the fabric is between 20 and 50 cm/min.

Also, the movement velocity of the fabric is 20 cm/min when the glass fiber mat has a thickness of 10 mm and a density of 0.11 g/cm$^3$.

Meanwhile, the second supply portion further includes a stirring motor and a stirring wing for mixing materials received in the tank; a level gauge for measuring the amount of functional solution mixed in the tank; and a pneumatic pressure adjustment device for adjusting the pressure inside the tank.

Here, the inner pressure of the tank is maintained between 4 and 5 kg/cm$^2$.

Also, the stirring velocity when mixing in the tank is between 1,200 and 2,000 rpm.

Also, the stirring velocity after mixing in the tank is between 40 and 60 rpm.

Meanwhile, the distributing device includes a supply line having one end connected to the tank; and a distributor mounted on the other end of the supply line to supply the functional solution to the injection portion.

Also, the injection portion further includes a supporting member arranged across the direction of progress of the fabric; a first robot installed at both ends of the supporting member so that the supporting member moves reciprocally backward and forward with respect to the direction of progress of the fabric; a second robot mounted on the supporting member; a needle block mounted on the lower part of the second robot and configured to move upward and downward by the second robot; a needle valve mounted on the needle block and configured to receive the functional solution from the distributing device; and a needle socket mounted with the needle, the needle socket having been installed on the needle block to introduce the functional solution received from the needle valve and passing through the needle block.

Here, the needle valve is adjusted so that a single dose of the functional solution discharged from the needle is between 0.5 and 0.7 ml/cm$^2$.

Also, the pressure of discharging the functional solution from the needle is between 2 and 5 kgf/cm$^2$.

Also, the needle is mounted on the needle block in reverse direction with respect to the movement direction of the fabric while being inclined at an angle between 10 and 45°.

Also, one of the needle blocks is arranged or a plurality of needle blocks are continuously arranged in the longitudinal direction of the supporting member.

Also, the needle block has a length to have 5 to 10 needle valves mounted thereon.

Also, the needle is configured to comprise a plurality of sets where 5 to 10 needles installed at an interval of between 1 and 1.5 cm form one set, and one set is supplied with the functional solution from one needle valve.

Here, 10 needles are arranged in every 10 cm, and one needle is in charge of an area of 1 cm$^2$.

In this case, the needle has a head between 18 and 24 G.

Also, the needle discharges the functional solution several times while moving upward being inserted in the fabric.

Also, the needle discharges the functional solution for the first time at 2±5 mm from the lower surface of the fabric and discharges the functional solution for the last time at 2±5 mm from the upper surface of the fabric.

Meanwhile, the system for injecting a functional solution for fabric according to the present invention further includes a supply roller to control the transfer and transfer velocity of the fabric, in the front portion and back portion of the injection portion.

Also, the drying portion further includes a conveyer installed to transfer the fabric discharged from the injection portion; a height adjustment plate installed to form a slot through which the fabric passes by adjusting its height from the bottom surface to adjust the thickness of the inflated fabric while removing the solvent after the functional solution is injected; and a fixing member installed at both ends of the height adjustment plate to allow the thickness adjustment plate to move.

Also, the drying portion further includes a heat exchanger installed at the rear side of the hot air blower or blower to convert the solvent evaporated by the hot air blower or blower into liquid; and a vacuum device for collecting the solvent converted into liquid in the heat exchanger.

Also, the system for injecting a functional solution for fabric according to the present invention further includes, between the injection portion and the drying portion, a coating portion or a penetration portion for coating a functional solution or a wetting agent comprising an aerogel powder mixed with an adhesive binder and an adhesive.

Here, the coating portion includes a nozzle installed to spray a functional solution supplied from the supply device on the fabric, and at least one pressure roller installed to apply pressure on the surface of the fabric coated with the functional solution, or a nozzle installed to receive a wetting agent comprising an aerogel powder mixed with an adhesive binder and an adhesive from the supplier and coat it on the fabric, and at least one pressure roller installed to apply pressure on the surface of the fabric coated with the wetting agent.

Also, the penetration portion includes a supply unit installed to supply the wetting agent comprising an aerogel powder mixed with an adhesive binder and an adhesive, and a plurality of penetration paddles installed to coat the wetting agent supplied from the supply unit on the fabric while rotating.

Meanwhile, the method for manufacturing fabric using the system for injecting a functional solution for fabric according to the present invention includes step 10 of manufacturing a functional solution by introducing functional materials and a solvent into the tank, and mixing with the stirring motor and the stirring wing (S10); step 11 of supplying fabric wound around the supply roll to the injection portion by operating the supply roller installed in the front portion and back portion of the injection portion (S11); step 12 of supplying the functional solution manufactured in the tank to the needle valve of the injection portion through a supply line connected to the tank and the distributor (S12); step 13 of supplying the functional solution introduced to the needle valve to the needle by passing through the needle block and the needle socket, and injecting the functional solution inside the fabric by having the needle inserted in the fabric while moving reciprocally (S13); step 14 of removing the solvent from the fabric by discharging hot air of a temperature higher than the boiling point of the solvent on the fabric injected with the functional solution (S14); step 15 of adjusting the thickness of the fabric by allowing the fabric injected with the functional solution and inflated while removing the solvent to pass through a slot formed by the height adjustment plate placed at a predetermined height from the lower surface (S15); and step 16 of collecting the fabric by winding fabric passing through the slot around the collecting roll (S16).

Here, in step 13 (S13), the needle moves up and down, and moves reciprocally backward and forward with respect to the movement direction of the fabric, the reciprocating movement being performed by allowing the needle block mounted with the needle to move up and down by the second robot, and the supporting member fixed with the second robot to move forward and backward by a first robot.

Also, in step 13 (S13), the needle injects the functional solution on the fabric several times while moving upward after being injected into the fabric and getting out from the fabric.

Also, after step 13 (S13), the method further includes a step of coating the functional solution on the fabric or a wetting agent comprising aerogel mixed with an adhesive binder and an adhesive on the outer surface of the fabric (S13-1).

Also, in step 14 (S14), the solvent is collected by converting the solvent evaporated by hot air into a liquid.

Hereinafter, with reference to the accompanying drawings, the present invention is described in detail with preferred embodiments so that a person having ordinary knowledge in the art to which the present invention pertains can easily carry out the present invention. However, in describing in detail the operation principles of the preferred embodiments of the present invention, if certain details of the disclosed functions or constitutions are determined to make the gist of the present invention unclear, they have been omitted.

Construction

Figure 2:
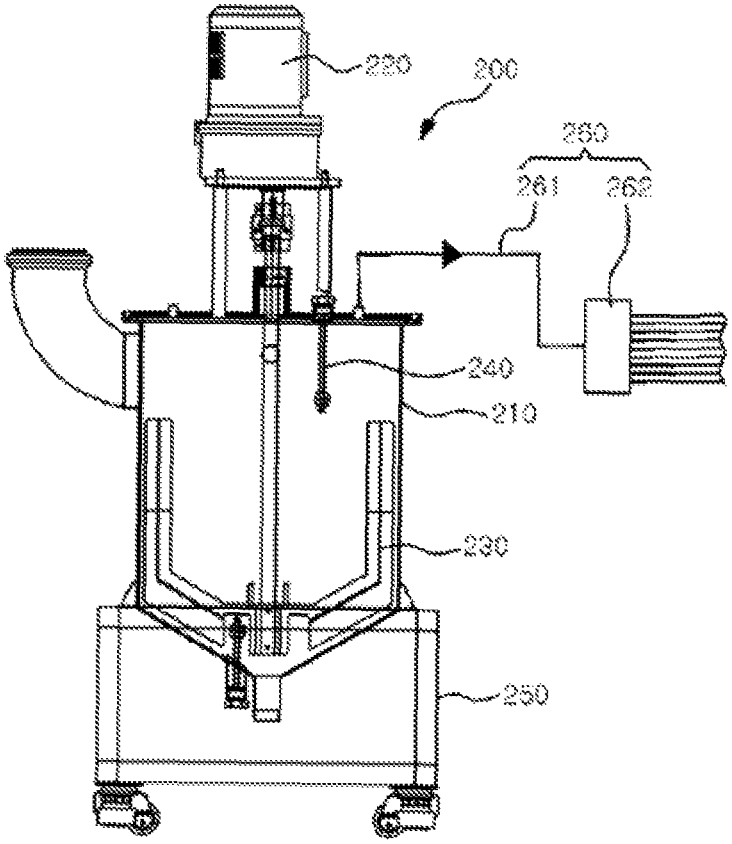
FIG. 2 is a mimetic diagram schematically illustrating a second supply portion manufacturing and supplying the functional solution supplied to the injection portion illustrated in FIG. 1.
Figure 3:
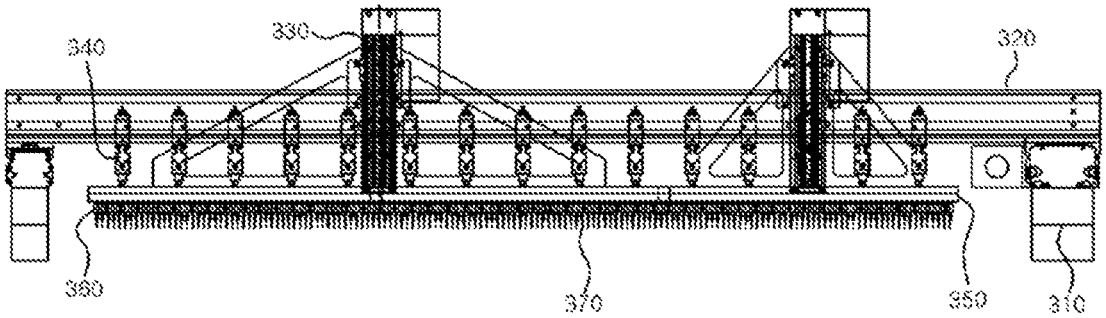
FIG. 3 is a front view schematically illustrating a needle device injecting a functional solution from the injection portion illustrated in FIG. 1.
Figure 4:
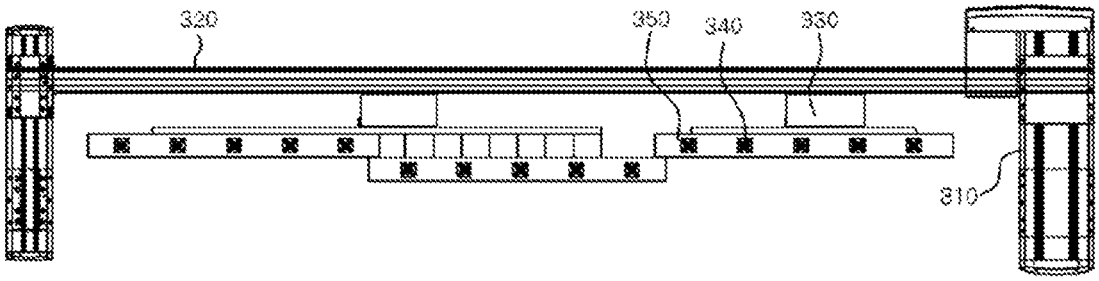
FIG. 4 is a plan view of FIG. 3.
Figure 5:
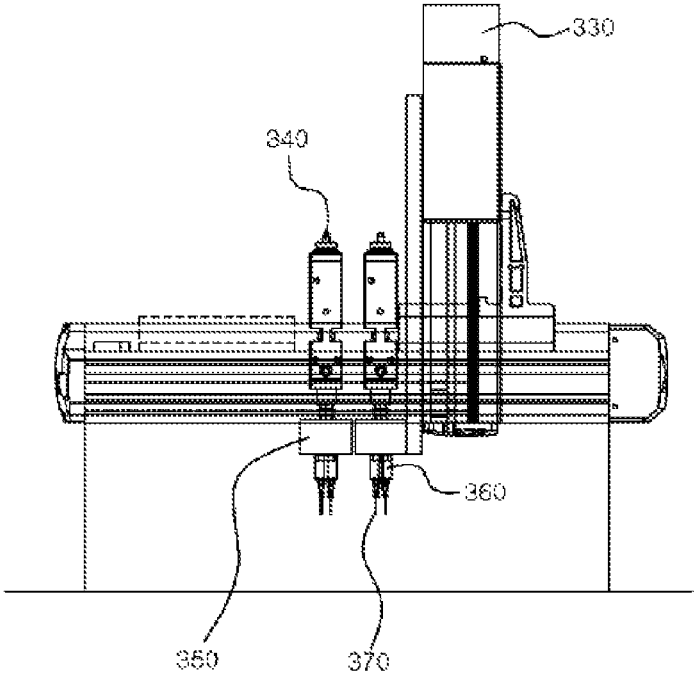
FIG. 5 is a side view of FIG. 3.
Figure 6:
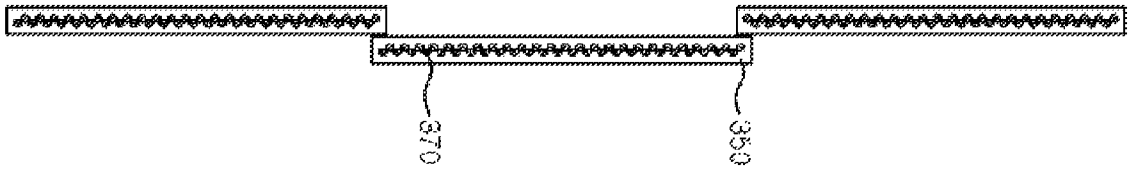
FIG. 6 is a bottom view illustrating the needle illustrated in FIG. 3.

FIG. 1 is a perspective view schematically illustrating a system for injecting a functional solution for fabric according to a preferable embodiment of the present invention. FIG. 2 is a mimetic diagram schematically illustrating a supply portion for manufacturing and supplying the functional solution supplied to the injection portion illustrated in FIG. 1. FIG. 3 is a front view schematically illustrating a needle portion injecting a functional solution from the injection portion illustrated in FIG. 1. FIG. 4 is a plane view of FIG. 3. FIG. 5 is a side view of FIG. 3. FIG. 6 is a bottom view illustrating the needle illustrated in FIG. 3.

As illustrated in FIG. 1, the system for injecting a functional solution for fabric according to the present invention includes a first supply portion 100, a second supply portion 200, an injection portion and a drying portion 400. Here, the fabric is supplied and collected by the general roll to roll structure.

As illustrated in FIG. 1, a supply portion 100 is a portion for supplying fabric providing functions, and it includes a supply roll 110 for winding fabric. In addition, it further includes an ordinary tension device (not shown) installed to tightly stretch the fabric passing through the injection portion 300 in the supply roll 110, and an auxiliary roller (not shown) installed to allow the fabric moving through the tension device to be converted to an angle (for example, horizontal angle) optimum for injecting the functional solution while maintaining its tightly stretched condition.

Also, the tension device allows the fabric to be in a tightly stretched condition by providing an external force by contacting the surface of the fabric unrolled from the supply roll 110. Also, the auxiliary roller is arranged between the tension device and the injection portion 300. Here, the appropriate movement velocity of the fabric moving according to the roll to roll method is between 20 and 50 cm/min, and this is adjusted in association with the velocity of injecting the functional solution from the injection portion 300 to the fabric. For example, as for a glass fiber mat of 0.11 g/cm$^3$ having a thickness of 10 mm, a velocity of 20 cm/min is appropriate in association with the injection velocity of the injection portion 300.

Also, for example, the fabric may have a non-woven form such as inorganic glass fiber mat, PE non-woven fabric, PET non-woven fabric or organic fiber. The appropriate thickness of the fabric is between 5 and 20 mm. When the thickness is less than 5 mm, it is difficult to insert the needle at an exact location inside the fabric, and when the thickness exceeds 20 mm, it takes a long time to introduce the functional solution, and thus the efficiency of continuous manufacturing and mass production gets lower. Also, in consideration of the type and density of the fabric, as for inorganic glass finer mat, preferably, the density is between 0.09 and 0.11 g/cm$^3$, and as for organic fiber, preferably, the density is between 0.025 and 0.03 g/cm$^3$. When the density is lower than this, the functional solution injected may easily leak outside, and when the density is higher, this would adversely affect the injection amount and dispersion velocity, etc. for spreading out after being injected. Of course, limitation on the thickness and density of the fabric is for work efficiency when injecting the functional solution into each fabric, and in consideration of the inefficiency mentioned in the above, it is obvious that the injection system according to the present invention may be applied to all fabric regardless of its type, thickness and density.

A second supply portion 200 is a portion for manufacturing a functional solution and supplying it to the injection portion 300. As illustrated in FIG. 2, it includes a tank 210 for introducing a plurality of functional materials, a stirring motor 220 and a stirring wing 230 for stirring materials received in the tank 210, a level gauge 240 for measuring the amount of material introduced into the tank 210 and the amount of functional solution having materials stirred in, a tank frame 250 in which the tank 210 is mounted to move the tank 210, and a pneumatic pressure adjustment and distributing device 260 for adjusting the pressure inside the tank 210. Also, it further includes a plurality of material storage tank (not shown) for storing functional materials according to type, and supplying them to the tank 210 in a predetermined ratio.

Thus, when a plurality of functional materials is introduced into the tank 210, the stirring motor 220 operates and the stirring wing 2230 moves to mix the functional materials and manufacture a functional solution.

The functional solution is made by mixing materials providing functions such as insulation, waterproofing, antifouling, antibacterial, and flame retardant, etc. properties with the solvent. Here, a binder had to be added to the aerogel powder in the conventional coating or wetting method. However, in the present invention, since the functional solution is directly injected to the fabric with a needle, a binder is not added.

For example, when the main function of the functional solution is insulation, an aerogel powder of a weight ratio between 5 and 15 is mixed with a solvent. Here, the particle size of the aerogel powder is about 20±5 μm, and preferably, the viscosity of the functional solution is approximately 1,500 cp or lower, and a viscosity between 700 and 1,500 cp is appropriate. The aerogel powder of this particle size and functional solution of this viscosity are to allow a sufficient amount of aerogel powder to be contained for insulation without blocking the needle when the functional solution passes through the needle 370 (see FIG. 3). Also, at least one of an organic solvent such as normal hexane, heptane, toluene, xylene, etc., or an alcohol including methyl alcohol or ethyl alcohol, or a non-polar solvent is used to facilitate the dispersion of aerogel powder. Preferably, normal hexane which has a low boiling point (b.p) is used. This is because the solvent is to be removed from the fabric by evaporating the solvent in the drying portion 400. Also, one or two or more of micro powder such as titanium dioxide ($TiO_2$), aluminum oxide ($Al_2O_3$), silicon carbide (SiC) and iron hydroxide ($Fe_2O_3$) is added in a weight ratio between 2 and 5 as an additive for improving the insulation properties at a high temperature. The viscosity of the functional solution added with these additives is maintained at a viscosity between 700 and 1,500 cp.

Here, the inner pressure of the tank 210 is adjusted to between 4 and 5 kg/cm$^2$ by a pneumatic pressure adjustment device to facilitate mixing, and this pneumatic pressure adjustment device includes a compressor. Also, the velocity of the stirring motor 220 when mixing is 1,200 rpm in minimum, preferably, maintained at approximately between 1,200 and 2,000 rpm. Also, the velocity of the stirring motor 220 when supplying a functional solution after mixing is between 40 and 60 rpm, preferably, maintained at 50 rpm. This is to prevent the aerogel powder and additive powder from subsiding in the functional solution or prevent concentration difference according to location.

Also, a distributing device 260 is for supplying a functional solution manufactured by the tank 210 to an injection portion 300, and it is installed between the tank 210 and the injection portion 300. The distributing device 260 includes a supply line 261 having one end connected to the tank 210, and a distributor 262 installed on the other end of the supply line 261 to provide the functional solution to the needle valve 340 of the injection portion 300, described below.

Meanwhile, as illustrated in FIGS. 3 to 6, an injection portion 300 is a portion for injecting a functional solution supplied from a distributor 262 of a distributing device 260 to the fabric. It includes a first robot 310, a supporting member 320, a second robot 330, a needle valve 340, a needle block 350, a needle socket 360, and a needle 370. Also, a supply roller (not shown) for controlling the transfer and transfer velocity of the fabric is further installed in the front portion and back portion of the injection portion 300. As a schematic explanation on the operation and function of the injection portion 300, the supporting member 320 moves reciprocally in the movement direction of fabric by a first robot 310, and the needle block 350 mounted with a needle valve 340, a needle socket 360 and a needle 370 moves reciprocally up and down by a second robot 330 while being fixed to the supporting member 320, so as to inject the functional solution into the fabric. Also, preferably, the needle valve 340, needle block 350, needle socket 360 and needle 370 are made of aluminum to reduce weight as much as possible.

First, as illustrated in FIG. 3, a first robot 310 is a device allowing the supporting member 320 to move forward and backward reciprocally in the movement direction of the fabric. It is installed at both sides of the conveyor 410 in which the fabric is received to support the supporting member 320 arranged across the movement direction of fabric, so that both ends of the supporting member 320 are mounted. In order for the supporting member 320 to move reciprocally, the first robot 310 has a rail of a predetermined length in the movement direction of the fabric as long as the predetermined length shown in FIG. 4 and FIG. 5. Thus, the supporting member 320 moves forward and backward reciprocally in the movement direction of fabric by the first robot 310.

Also, a supporting member 320 is a member for fixing a second robot 330. It is fixed across a pair of first robots 310, and one or a plurality of second robots 330 are installed therebetween.

Also, a second robot 330 is a device for allowing the needle block 350 to move reciprocally up and down. One or a plurality of second robots 330 are installed at a predetermined location of the supporting member 320, and a needle block 350 is fixed in the lower part. The second robot 330 is made to move the needle block 350 up and down while being supported by the supporting member 320.

Also, a needle valve 340 is a member for adjusting the amount of a single dose while guiding the functional solution supplied from the distributor 262 toward the needle block 350. One end of the needle valve is connected to a distributor 262, and the other end is installed in the needle block 350. The needle valve 340 supplies the functional solution by adjusting the amount of functional solution discharged from one needle 370 to be between 0.5 and 0.7 ml/cm$^2$.

Also, a needle block 350 is a member mounted with a needle valve 340 connected with a distributor 262 and a needle socket 360 mounted with a needle 370. It is configured so that the functional solution flowing from the needle valve 340 passes through the needle socket 360. As illustrated in FIG. 6, one or a plurality of needle blocks 350 are consecutively arranged in the length direction of the supporting member 320. A plurality of them may be installed in a straight line, and as shown in the drawings, they may be installed varying the center line. Each needle block 350 is long enough to have 5 to 10 needle valves 340 mounted thereon. In particular, an inclined surface of a predetermined angle is formed in the lower part of the needle block 350, and the needle socket 360 is mounted in reverse direction with respect to the movement direction of the fabric while being inclined at an angle between 10 and 45°. The needle socket 360 has an inclined angle to easily insert the needle 370 moving back and front, and up and down with respect to the moving fabric. Also, the upper surface of the needle block 350 mounted with the needle valve 340 may be horizontal, and in some cases, it may form an inclined surface.

Also, the needle socket 360 is mounted on an inclined surface of the lower surface of the needle block 350, and installed to flow to the needle 370 when a functional solution supplied from the needle valve 340 is introduced passing through the needle block 350. One needle 370 is mounted on each needle socket 360.

Also, a needle 370 is a member for injecting a functional solution supplied from the needle socket 360 inside the fabric. The size of the head is between 18 and 24 G, its length is between 30 and 50 mm, preferably 40 mm. The needle 370 is configured to comprise a plurality of sets where 5 to 10 needles 370 installed at an interval of between 1 and 1.5 cm form one set, and one set of needles 370 discharges a functional solution supplied from one or two to three needle valves 340. For example, the functional solution supplied from one needle valve 340 is supplied to 5 to 10 needles 370, which is one set, through the needle socket 360. Also, the pressure of discharging a functional solution from the needle 370 is 2 kg/cm$^2$ in minimum, or between 2 and 5 kg/cm$^2$. Also, for example, ten needles 370 are arranged in every 0.1 m, and one needle 370 is in charge of an area of 1 cm$^2$. Also, the needle 370 is mounted on the lower part of the needle block 350 in reverse direction with respect to the movement direction of the fabric while being inclined at an angle between 10 and 45°. Preferably, the needle socket 360 is installed on the needle block 350 in the same angle, but in some cases, the needle 370 may be installed at an angle between 10 and 45° presented above regardless of the angle of the needle socket 360.

Here, the amount of a single dose of the functional solution discharged through the needle 370 is between 0.5 and 0.7 ml/cm$^2$. Also, the needle 370 is configured to discharge the functional solution one to three times while moving upward being inserted in fabric of a predetermined thickness by a first robot 310 and second robot 330 and getting out from the fabric. Of course, when the fabric is thicker, the functional solution may be discharged more frequently. For example, the needle 370 is configured to be discharged for the first time at a depth of 2.0±5 mm from the lower surface of the fabric and discharged for the last time at a depth of 2.0±5 mm from the upper surface. The moving distance of the needle 370 is possible because the thickness of the fabric is predetermined to move the second robot 330 precisely. The distance between each needle 370 is between 1 and 1.5 cm, and this is associated with the degree of predetermined amount of functional solution discharged by inserting a needle 370 in the fabric at a predetermined location and the predetermined amount of functional solution discharged by inserting the needle in the fabric at the next location spread out and impregnated evenly throughout the fabric. When the distance between each needle 370 is too far or too close, the amount of functional solution impregnated would be too much, thereby overflowing, or would be too little, thereby deteriorating the function effect.

A drying portion 300 is a portion for leaving only the functional material by evaporating the solvent from the fabric while moving the fabric discharged from the injection portion 300. It includes a conveyor 410 and a hot air blower (or blower).

First, a conveyor 410 is mounted with fabric discharged from the injection portion 300, and is installed throughout the entire length of the drying portion 400 to guarantee safe transfer until the fabric mounted passes through the drying portion 400.

Also, a hot air blower or blower is an equipment for evaporating the solvent by discharging hot air on the fabric transferred along the conveyor 410. It discharges hot air of a temperature higher than the boiling point of the solvent mixed in the second supply portion 200.

Also, a drying portion 400 may have a heat exchanger and a vacuum device further installed at the rear side of the hot air blower or blower. This is to evaporate the solvent absorbed in the fabric with hot air discharged from the hot air blower or blower, and collect the solvent by converting it into liquid in the heat exchanger and collecting it with the vacuum device.

Also, the drying portion 400 further includes a height adjustment plate 420 for forming a slot through which the fabric passes by adjusting its height from the lower surface to adjust the thickness of the inflated fabric while removing the solvent after the functional solution is injected, and a fixing member 430 having both ends of the height adjustment plate 420 mounted thereon. In this case, the height adjustment plate 420 is installed to move up and down along the fixing member 430 varying its height according to the thickness of the fabric. That is, it is fixed to move up and down along the fixing member 420 of the height adjustment plate 420 according to the type and thickness of the fabric.

Meanwhile, although not illustrated in the drawings, a coating portion or a penetration portion is further installed between the injection portion 300 and the drying portion 400 so that the fabric is coated with a functional solution on the outer surface of the fabric before entering the drying portion 400 after passing through the injection portion 300 by the conventional coating and wetting method or with a wetting agent comprising an aerogel powder once again. In this case, a separate tank is prepared for manufacturing a wetting agent, and a separate supply device is installed to supply the wetting agent from the tank.

Also, for example, the coating portion includes a nozzle installed to spray the functional solution supplied from the distributing device 260 on the fabric, and at least one pressure roller installed to apply pressure on the surface of the fabric coated with the functional solution.

Also, as another example, the coating portion includes a nozzle installed to receive a wetting agent comprising an aerogel powder mixed with an adhesive binder and an adhesive from the supplier and coat it on the fabric, and at least one pressure roller installed to apply pressure on the surface of the fabric coated with the wetting agent.

Also, for example, the penetration portion includes a supply unit installed to supply the wetting agent comprising an aerogel powder mixed with an adhesive binder and an adhesive, and a plurality of penetration paddles installed to coat the wetting agent supplied from the supply unit on the fabric while rotating.

Also, although not illustrated in the drawings, the fabric passing through the drying portion 400 is obviously collected at the collecting roll of the collection portion.

Manufacturing Method

Figure 7:
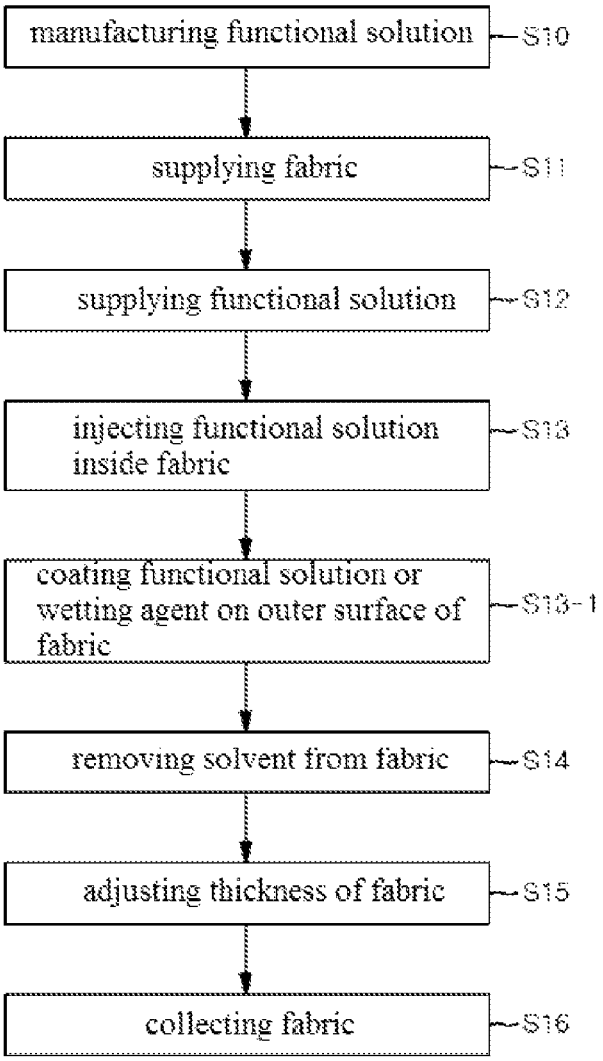
FIG. 7 is a flow chart illustrating a method for manufacturing fabric using the injection system illustrated in FIG. 1.

FIG. 7 is a flow chart illustrating a method for manufacturing fabric using the injection system illustrated in FIG. 1.

First, a functional solution is manufactured by mixing functional material in the tank 210 of the second supply portion 200 (S10). In this case, one or a plurality of functional materials having insulation, waterproofing, antifouling, antibacterial, and flame retardant, etc. functions is mixed in a solvent of at least one of an organic solvent such as normal hexane, heptane, toluene, xylene, etc., or an alcohol including methyl alcohol or ethyl alcohol, or a non-polar solvent.

For example, when the main function of the functional solution is insulation, an aerogel powder having particles of the size of 20±5 mm is mixed with a solvent in a weight ratio between 5 and 15, and the viscosity of the mixed functional solution is between 700 and 1,500 cp. In this case, normal hexane which has a low boiling point is used as a solvent, and this is to easily evaporate the solvent with hot air in the drying portion 400. Also, one or two or more of micro powder such as titanium dioxide (TiO2), aluminum oxide (Al2O3), silicon carbide (SiC) and iron hydroxide (Fe2O3) is added to the functional solution in a weight ratio between 2 and 5 as an additive for improving the insulation properties at a high temperature.

Also, the inner pressure of the tank 210 is between 4 and 5 kg/cm$^2$, the stirring velocity when mixing is between 1,200 and 2,000 rpm, and the stirring velocity after mixing is between 40 and 60 rpm, preferably 50 rpm.

The manufactured functional solution is supplied through a supply line 261 connected to the tank 210 and a distributor 262.

Next, fabric is supplied (S11). Fabric winding the supply roll 110 is supplied to the injection portion 300. In this case, preferably, the movement velocity of the fabric is between 20 and 50 cm/min. For example, a fabric of 0.11 g/cm$^3$ having a thickness of 10 mm moves at a velocity of 20 cm/min.

Next, a functional solution is supplied (S12). The functional solution stored in the tank 210 is supplied to the needle valve 340 of the injection portion 300 through a supply line 261 connected to the tank 210 and a distributor 262. In this case, the needle valve 340 is adjusted so that a single dose of the functional solution discharged from the needle 370 is between 0.5 and 0.7 ml/cm$^2$.

Next, the functional solution supplied from the second supply portion 200 is injected inside the fabric from the injection portion 300 (S13). The functional solution supplied from the needle valve 340 flows to the needle 370 by passing through a needle block 350 and a needle socket 360. Also, the functional solution is injected after allowing the needle to be inserted in the fabric by allowing the supporting member 320 to move forward and backward with respect to the fabric direction by a first robot 310, and the needle block 350 to move up and down by a second robot 330 mounted on the supporting member 320. In this case, the functional solution is injected for the first time at a depth of 2.0±5 mm from the lower surface of the fabric through a needle 370, and injects for the last time at a depth of 2.0±5 mm from the upper surface of the fabric while the needle 370 moves upward and gets out from the fabric. The number of injections varies according to the thickness of the fabric. Also, the angle of the needle 370 inserted into the fabric is in reverse direction with respect to the movement direction of the fabric while being inclined at an angle between 10 and 45°.

Next, a functional solution is coated on the fabric injected with the functional solution or a wetting agent comprising aerogel mixed with an adhesive binder and an adhesive is coated on the outer surface of the fabric (S13-1). At this time, a separate tank is prepared for manufacturing a wetting agent, and a separate supply device is installed to supply the wetting agent from the tank to the injection portion 300.

Next, the solvent is removed by hot air by allowing the fabric injected with functional solution to pass through the drying portion 400 (S14). The temperature of hot air is higher than the boiling point of the solvent.

Next, the thickness is adjusted by allowing the fabric removed with the solvent to pass through a slot of a predetermined height (S15). In this case, the slot is formed by fixing the height adjustment plate 420 to be apart from the lower surface at a predetermined height. The height of the slot varies according to the thickness of the fabric.

Finally, the fabric is collected (S16). The fabric dried by passing through the drying portion 400 winds the collecting roll.

As described above, a person skilled in the art to which the present invention pertains can understand that the present invention can be carried out in different embodiments without modifying the technical sprit or essential characteristics. Thus, it should be understood that the above-described embodiments are by way of example in every aspect, and are not intended to limit the present invention. The scope of the present invention is defined by the following claims, rather than by the detailed description. Further, it should be appreciated that all modifications or modified forms derived from the definition, scope, and equivalents of the claims fall under the scope of the present invention.

What is claimed is:

1. A system for injecting a functional solution for fabric, comprising:

a first supply portion provided with a supply roll for winding fabric;

a second supply portion provided with a tank for manufacturing a functional solution by mixing functional materials having insulation, waterproofing, antifouling, antibacterial, and/or flame retardant properties with solvents, and a distributing device for discharging the functional solution stored in the tank;

an injection portion provided with a needle for injecting the functional solution supplied from the distributing device to inside the fabric transferred from the first supply portion, wherein the injection portion further comprises:

a supporting member arranged across the direction of progress of the fabric;

a first robot installed at both ends of the supporting member so that the supporting member moves reciprocally backward and forward with respect to the direction of progress of the fabric;

a second robot mounted on the supporting member;

a needle block mounted on the lower part of the second robot configured to move upward and downward by the second robot;

a needle valve mounted on the needle block and configured to receive the functional solution from the distributing device; and a needle socket mounted with the needle, the needle socket installed on the needle block to introduce the functional solution received from the needle valve and passing through the needle block;

a drying portion provided with a hot air blower or a blower for discharging hot air of a temperature higher than a boiling point of the solvent in order to evaporate the solvent from the fabric passing through the injection portion; and a collection portion provided with a collecting roll for winding the fabric passing through the drying portion.

2. The system of claim 1, wherein the functional solution is made by mixing an aerogel powder with a solvent.

3. The system of claim 2, wherein the aerogel powder has a particle size of 20±5 μm.

4. The system of claim 2, wherein the aerogel powder is mixed at a weight ratio between 5 and 15.

5. The system of claim 2, wherein the solvent is one of: an organic solvent including normal hexane, heptane, toluene, and/or xylene; an alcohol including methyl alcohol and/or ethyl alcohol; or a non-polar solvent.

6. The system of claim 3, wherein the functional solution includes one or two or more of: titanium dioxide (TiO2), aluminum oxide (Al2O3), silicon carbide (SiC) and iron hydroxide (Fe2O3) micro powder added thereto at a weight ratio between 2 and 5.

7. The system of claim 2, wherein the viscosity of the functional solution is between 700 and 1,500 centipoise (cp).

8. The system of claim 1, wherein the fabric is one of inorganic glass fiber mat, polyethylene (PE) non-woven fabric, polyethylene terephthalate (PET) non-woven fabric or organic fiber mat.

9. The system of claim 8, wherein the thickness of the fabric is between 5 and 20 mm.

10. The system of claim 8, wherein the movement velocity of the fabric is between 20 and 50 cm/min.

11. The system of claim 1, wherein the second supply portion further comprises:

a stirring motor and a stirring wing for mixing materials received in the tank;

a level gauge for measuring the amount of functional solution mixed in the tank; and a pneumatic pressure adjustment device for adjusting the pressure inside the tank.

12. The system of claim 1, wherein the distributing device comprises:

a supply line having one end connected to the tank; and a distributor mounted on the other end of the supply line to supply the functional solution to the injection portion.

13. The system of claim 1, wherein the needle valve is adjusted so that a single dose of the functional solution discharged from the needle is between 0.5 and 0.7 ml/cm$^2$.

14. The system of claim 1, wherein the pressure of discharging the functional solution from the needle is between 2 and 5 kgf/cm$^2$.

15. The system of claim 1, wherein the needle is mounted on the needle block in reverse direction with respect to the movement direction of the fabric while being inclined at an angle between 10 and 45°.

16. The system of claim 1, wherein one of the needle blocks is arranged or a plurality of needle blocks are continuously arranged in the longitudinal direction of the supporting member.

17. The system of claim 1, wherein the needle is configured to comprise a plurality of sets where 5 to 10 needles installed at an interval of between 1 and 1.5 cm form one set, and one set is supplied with the functional solution from one needle valve.

18. The system of claim 1, wherein the drying portion further comprises:

a conveyer installed to transfer the fabric discharged from the injection portion;

a height adjustment plate installed to form a slot through which the fabric passes by adjusting its height from a bottom surface to adjust the thickness of the inflated fabric while removing the solvent after the functional solution is injected; and a fixing member installed at both ends of the height adjustment plate to allow the height adjustment plate to move.

19. The system of claim 1, further comprising, between the injection portion and the drying portion, a coating portion or a penetration portion for coating a functional solution or a wetting agent comprising an aerogel powder mixed with an adhesive binder and an adhesive.

* * * * *